US007357266B2

(12) United States Patent
Giblin et al.

(10) Patent No.: US 7,357,266 B2
(45) Date of Patent: Apr. 15, 2008

(54) VENTING CLOSURE

(75) Inventors: Edward John Giblin, Hopatcong, NJ (US); Jaimee Terese Simone, Liverpool, NY (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 773 days.

(21) Appl. No.: 10/748,038

(22) Filed: Dec. 30, 2003

(65) Prior Publication Data

US 2005/0145634 A1 Jul. 7, 2005

(51) Int. Cl.
*B65D 53/00* (2006.01)

(52) U.S. Cl. ..... 215/261; 215/341; 222/481.5

(58) Field of Classification Search ..... 222/481.5; 220/367.1; 215/261, 341
See application file for complete search history.

(56) References Cited

U.S. PATENT DOCUMENTS

| | | | | |
|---|---|---|---|---|
| 2,254,815 | A * | 9/1941 | Barnby et al. | 215/261 |
| 3,521,784 | A | 7/1970 | Gaines et al. | 215/56 |
| 3,951,293 | A | 4/1976 | Schulz | 215/261 |
| 3,993,208 | A * | 11/1976 | Ostrowsky | 215/216 |
| 4,684,554 | A * | 8/1987 | Ou-Yang | 428/34.2 |
| 4,765,499 | A | 8/1988 | Von Reis et al. | 215/261 |
| 4,863,051 | A | 9/1989 | Eibner et al. | 215/261 |
| 5,117,999 | A | 6/1992 | Canzano et al. | 220/209 |
| 5,176,271 | A * | 1/1993 | Painchaud et al. | 215/261 |
| 5,289,932 | A * | 3/1994 | Dimeo et al. | 215/349 |
| 5,579,936 | A | 12/1996 | Costa et al. | 215/261 |
| 5,657,891 | A | 8/1997 | Bilani et al. | 220/256 |
| 5,692,634 | A | 12/1997 | Jenkins et al. | 220/256 |
| 5,730,306 | A | 3/1998 | Costa | 215/261 |
| 5,853,096 | A | 12/1998 | Bartur et al. | 215/261 |
| 5,882,454 | A | 3/1999 | Baginski et al. | 156/73.5 |
| 5,901,867 | A | 5/1999 | Mattson | 215/261 |
| 5,988,414 | A | 11/1999 | Schwarz et al. | 215/261 |
| 5,988,426 | A | 11/1999 | Stern | 220/371 |
| 6,085,927 | A | 7/2000 | Kusz | 220/23.87 |
| 6,277,478 | B1 * | 8/2001 | Kurita et al. | 428/200 |
| D470,054 | S | 2/2003 | Gerhart et al. | D9/524 |
| 6,523,724 | B2 | 2/2003 | Paulovich et al. | 222/189.09 |

* cited by examiner

*Primary Examiner*—Philippe Derakshani
(74) *Attorney, Agent, or Firm*—Milton L. Honig

(57) ABSTRACT

The present invention is directed to a venting closure that reduces the amount of headspace in a container. The venting closure has a patch that changes the location and reduces the size of the vent opening. Accordingly, the vent closure enables a container which has a vent opening to holds more product without having to expand the size of the container.

11 Claims, 4 Drawing Sheets

VENTING CLOSURE

FIELD OF THE INVENTION

The present invention is directed to a vent closure. More particularly, the invention is directed to a venting closure that reduces the amount of headspace required in a container.

BACKGROUND OF THE INVENTION

With the surge in popularity of purchasing products, such as heavy duty liquid laundry detergent, in bulk in retail outlets such as grocery stores, drug stores and especially so-called "club" stores, packaging for bulk items has become highly desired. One such type of package that has become popular is a container for heavy duty laundry detergent such as that shown in U.S. Pat. No. D470,054 to Gerhart et al. That package is a 300 fl. oz. size container which includes one or more top walls having a vent opening and closure, a handle, spigot for dispensing product, and a measuring cap which encloses the spigot.

While this package has been well received by the industry including manufacturers, retailers and consumers, a disadvantage is that it requires a large amount of headspace such that when the container is placed on its front wall during use, the product level is not higher than the bottom most of the vent opening since venting of the container requires partial unscrewing of the vent cap. If the product level was higher than the bottom most level of the vent opening, the product would spill out of the package through the vent opening. Thus, the container can in use hold much less than its actual volume. With the relatively large size of these containers it is preferable to be able to make better use of the actual volume of the container rather than make another larger container larger since a larger container is more cumbersome for the consumer to carry and larger containers require more shelf space in the store, use more plastic and cost more, as well as use more space and more secondary packaging during distribution to the retail outlets.

Accordingly, for such types of containers with a vent, there exists a need for a vent closure that enables more of the actual volume of the container to be used. In other words, there exists a need for such a container with a vent closure which enables the container to have less headspace.

An object of the present invention is to provide a venting closure that reduces the amount of headspace, thus enabling more of the actual volume of the container to be used.

Other objects of the present invention will become apparent to those skilled in the art by reference to the specification.

ADDITIONAL INFORMATION

Various vent closures are known that make use of gas permeable liquid impermeable closures.

Schulz, U S. Pat. No. 3,951,293 discloses a gas permeable liquid closure for containers of liquids or solids which emit or absorb gas. The closure includes a gas permeable film of unsintered tetrafluoroethylene polymer. The film is supported across an opening of the container by a perforated cap or perforated sealing diaphragm. The vent stopper is said to be suitable for containers of all kinds. The gas permeable material is an unsintered tetrafluoroethylene polymer with a fibrillated structure and a density of less than about 1.4. It may be suitable to support the film to be used on one or both sides by supporting members such as perforated disks, diaphragms, lattices, meshes or grates or the like. Holding devices can have distinct profile rings. In FIG. 3, the disk of unsintered tetrafluoroethylene polymer with a fibrillated structure and a density of less than about 1.4 is held only by ring-shaped ridges and practically the entire surface of the disk is available for the passage of gas without coming in contact in the center with the cover bottom or the lockable core.

Baginski et al., U.S. Pat. No. 5,882,454 discloses a venting cap with a hole and a semi-permeable membrane. The membrane is fitted in a housing of particular dimensions which is in turn fitted in a protrusion corresponding to the hole in the caps. The membrane is understood to be sufficiently permeable to gases which may be generated inside the container in order to allow the gases to escape to the ambient and sufficiently impermeable to the substance contained in the container in order to prevent significant leakage, preferably all of leakage. Suitable materials are said to include polyethylene, high and low density, polypropylene, nylon and PTFE. Preferred materials are polyethylene film sold under the trademark Tyvek and an acrylic copolymer cast on a non-woven support with a fluoro monomer post treatment sold under the trademark Versapor. The housing and the protrusion may be simply glued together, spin welded or interference fitted together. The cap may have a top wall and a depending skirt.

Stern, U.S. Pat. No. 5,988,426 discloses a disposable plastic lid formed with a vent hole. A filter formed of a material such as polytetrafluoroethylene is mounted over the vent hole.

Jenkins et al., U.S. Pat. No. 5,692,634 is directed to a rigid container structure for hermetic sealing of particulate solids which emit an off gas during containment. The chamber space is enclosed with a gas permeable imperforate membrane so as to selectively separate and retain an off gas out of contact with container contents. In FIGS. 8 and 9, a lattice arrangement is illustrated.

Eibner, U.S. Pat. No. 4,863,051 discloses a lid for a container for gas releasing liquids which includes a sealing cap having an opening closed by means of a foil of gas permeable, but liquid non-permeable material.

Bartur et al, U.S. Pat. No. 5,853,096 is directed to a pressure equalizing and a foam eliminating cap having a disk made of gas permeable material which is sized so it fits within the annular seal.

Schwarz et al., U.S. Pat. No. 5,988,414 discloses a lid having a pressure compensation device comprising a gas permeable, liquid impermeable membrane. The membrane is integrated in an upper cover portion of the lid by injection molding.

However, there are a number of problems associated with such types of membranes. One such problem is that these type of membranes are expensive materials. Another problem with such membranes is that they are typically delicate items, both because of the materials typically used to make them, and because they are typically very thin.

Accordingly, another object of the present invention is to make an effective vent closure without the use of such membranes.

Other closure patents include Mattson, U.S. Pat. No. 5,901,867, Von Reis et al., U.S. Pat. No. 4,765,499, Painchaud et al., U.S. Pat. No. 5,176,271, Gaines et al., U.S. Pat. No. 3,521,784, Canzano et al., U.S. Pat. No. 5,117,999, Bilani et al, U.S. Pat. No. 5,657,891, Costa et al., U.S. Pat. No. 5,730,306, and Costa et al., U.S. Pat. No. 5,579,936.

SUMMARY OF THE INVENTION

In a first aspect, the present invention is directed to a venting closure comprising a cylindrical neck which extends from a container wall, wherein the cylindrical neck has an upper edge and has a given internal diameter that defines a venting opening having a given cross sectional area, and a liquid impermeable patch adhered to at least a portion of the upper edge of the cylindrical neck, wherein the patch covers the venting opening and has an aperture therein and wherein the aperture in the patch is smaller in area than the cross sectional area of the cylindrical neck and may be positioned in a predetermined area of the venting opening.

In a second aspect, the venting closure of the invention is used in conjunction with a large volume heavy duty liquid detergent container. The container comprises a dispensing opening, a top wall, a side wall, a bottom wall, a front wall, a back wall, a container venting opening in at least one of the top, back and side walls, and a venting closure, wherein the closure includes a cylindrical neck which extends from a container wall, wherein the cylindrical neck has an upper edge and has a given internal diameter that defines the venting opening having a given cross sectional area, and a liquid impermeable patch adhered to at least a portion of the upper edge of the cylindrical neck, wherein the patch covers the venting opening and has an aperture therein and wherein the aperture has a cross sectional area that is smaller than the cross sectional area of the cylindrical neck and may be positioned in a predetermined area of the venting opening.

In a third aspect, the venting closure of the invention is used in conjunction with a large volume heavy duty liquid detergent container which has a handle and a spigot for dispensing product. The container comprises a dispensing opening, a top wall, a side wall, a bottom wall, a front wall, a back wall, a container venting opening in at least one of the top, back and side walls, and a venting closure, wherein the closure includes a cylindrical neck which extends from a container wall, wherein the cylindrical neck has an upper edge and has a given internal diameter that defines the venting opening having a given cross sectional area, and a liquid impermeable patch adhered to at least a portion of the upper edge of the cylindrical neck, wherein the patch covers the venting opening and has an aperture therein and wherein the aperture has a cross sectional area that is smaller than the cross sectional area of the cylindrical neck and may be positioned in a predetermined area of the venting opening and wherein the container has a spigot for dispensing product from the dispensing opening and a handle.

In a preferred embodiment, the top wall of the container includes the venting closure, a vent cap for the venting closure, a handle, a dispensing opening and a dispensing closure covering the dispensing opening. Preferably, the closure for the dispensing opening includes a measuring cup.

The venting closure of the invention is a closure that partially closes a venting opening in a container wall. However, the venting closure of the invention has an aperture in it such that the venting closure also acts as a vent as well as a partial closure for the vent opening. Since the venting closure of the present invention acts as only a partial venting closure, it is preferred that a venting cap also be used to further close the venting opening.

The cross sectional area of both the venting opening and the patch aperture is the cross section perpendicular to the flow of air through the venting closure. In other words, it is the cross section taken parallel to the surface (either inner or outer) of the patch.

As used herein, the term "during use" means when the container having a vent closure of the invention is placed in position for product to be dispensed. For example, with the package shown in the figures herein, the container is ready for use and dispensing of product when the container is placed on its front side such that the spigot is ready to be operated to dispense product.

As used herein, the term "comprising" means that a specified material or element is present, optionally together a further material or element, and includes including, made up of, composed of, consisting and/or consisting essentially of.

For a more complete understanding of the above and other features and advantages of the invention, reference should be made to the following detailed description of preferred embodiments and to the accompanying drawings.

DETAILED DESCRIPTION OF THE INVENTION

Figure 1:
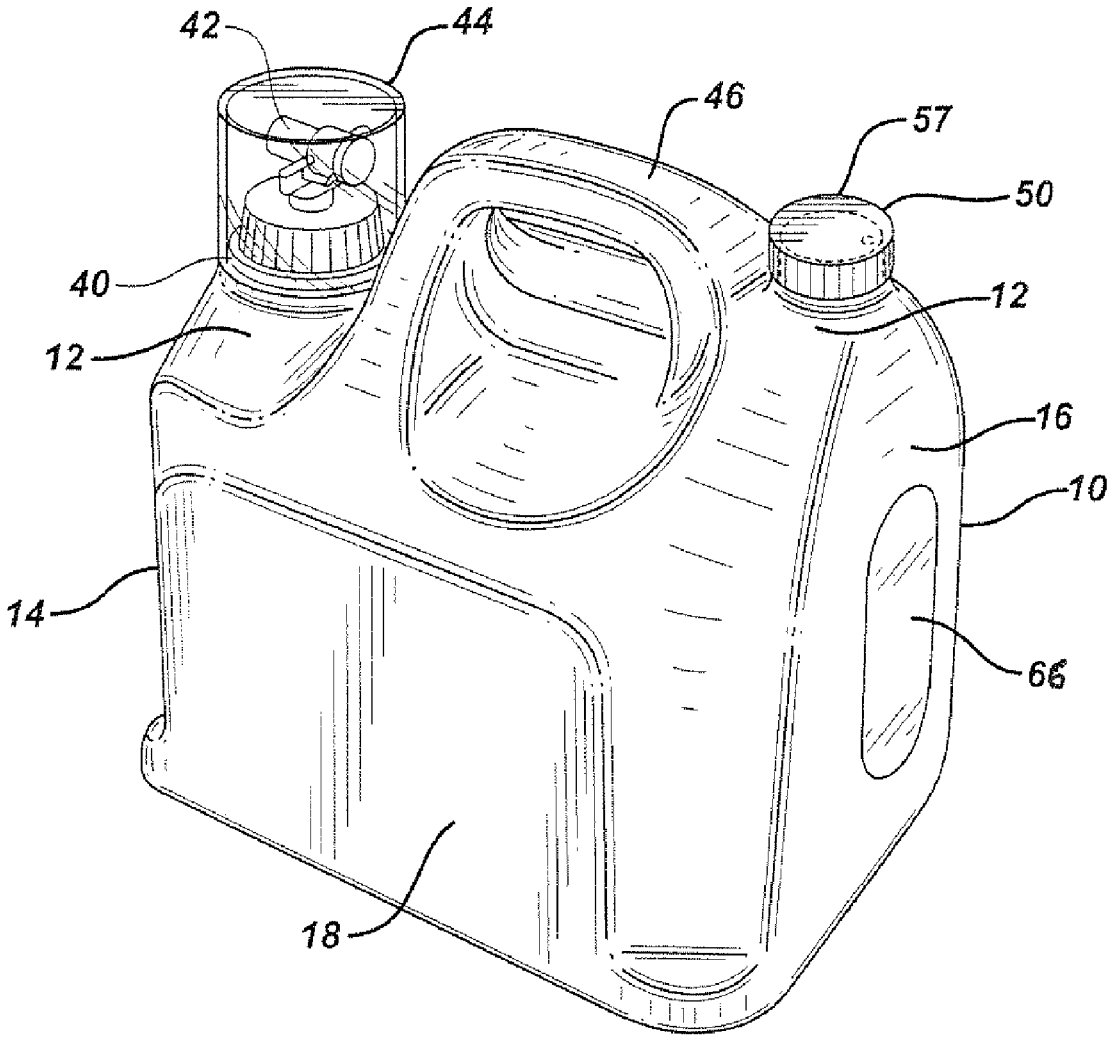
FIG. 1 is a perspective view of a container with a venting closure according to the invention.
Figure 2:
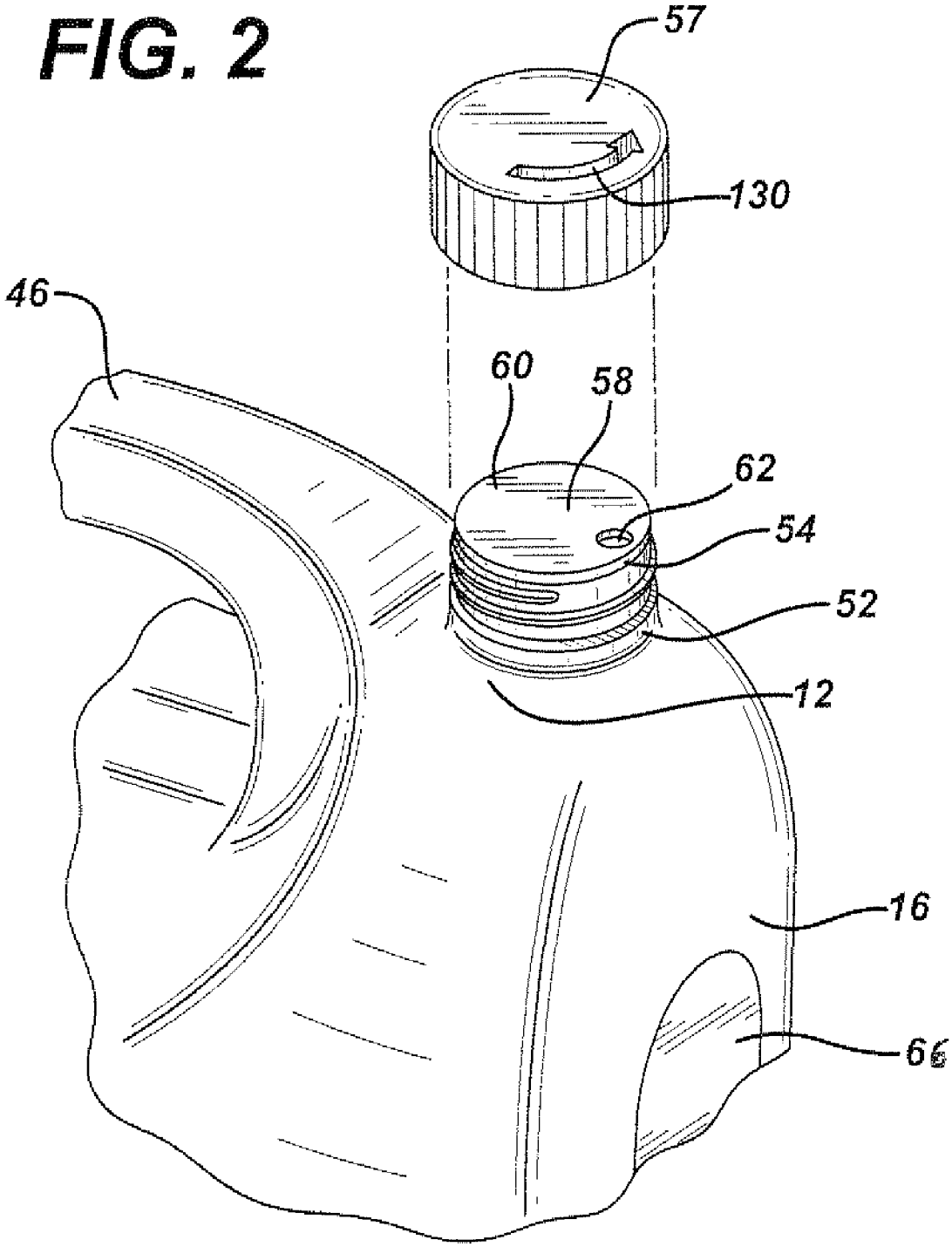
FIG. 2 is a perspective view of the portion of a container with a venting closure according to the invention.

Referring now particularly to the drawings, a venting closure of the invention will be described with respect to a specific embodiment.

Container 10 includes top wall 12, front wall 14, back wall 16 and side walls 18. A bottom wall supports the container.

Top wall 12 includes an area 40 in which is disposed a valve or spigot apparatus 42 and closure 44. Preferably, the closure 44 is a measuring cup. Handle 46 is integral with top wall 12.

Located on an opposite side of top wall 12 from spigot apparatus 42 is vent 50 which will be described further below. Back wall 16 includes oval etched area 60. The etching provides a non-uniform or rough surface for reasons which will be discussed below.

As can be seen, especially in FIG. 1, the top surfaces of measuring cup 44, handle 46, and vent cap 57 are generally parallel. Moreover, the heights of the top surfaces of the measuring cup 44 and the vent cap 57 are independently within one inch of the top surface of handle 46, especially within ¾ of an inch of the top surface of handle 46, and most preferably within ½ inch of the top surface of the handle 46. Keeping the top surfaces parallel and at approximately the same height facilitates the even distribution of top load of containers in that the effective top surface of the container seen by a container stacked on top of it will be more or less even whereby to prevent uneven stacking load of the containers which can lead to rupture of the container.

In order to dispense product, the user rests the container 10 on front wall 14. The valve or spigot apparatus 42 is then operated by the consumer to dispense product.

To facilitate dispensing of product, the container includes a vent closure 50 of the invention and a vent cap. The vent closure 50 of the invention comprises the container top wall 12 which acts as the base on which the vent 50 is located. A cylindrical neck 52 extends from container top wall 12. Cylindrical neck 52 has an upper edge 54 and has a given internal diameter that defines a vent opening 58 having a given cross sectional area. A liquid impermeable patch 60 is adhered to at least a portion of the upper edge 54 of the cylindrical neck 52. The patch 60 covers the vent opening 58 and has an aperture 62 that is smaller in cross sectional area than the cross sectional area of the cylindrical neck. The aperture 62 is positioned in a predetermined area of the vent opening 58. The vent 50 also includes a vent cap 57.

Figure 3:
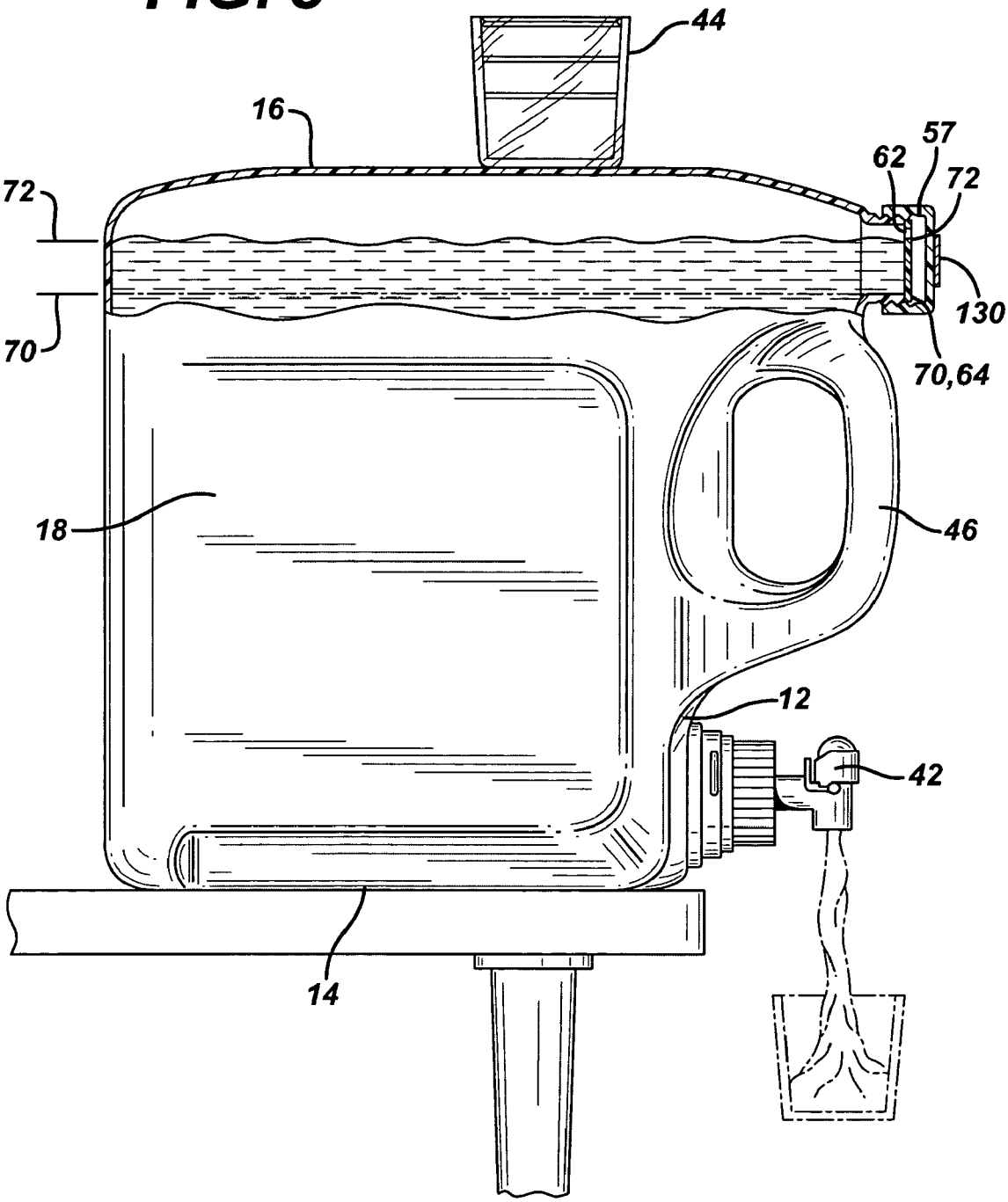
FIG. 3 is a side view of a container as positioned during use on its front wall with a venting closure according to the invention.
Figure 4:
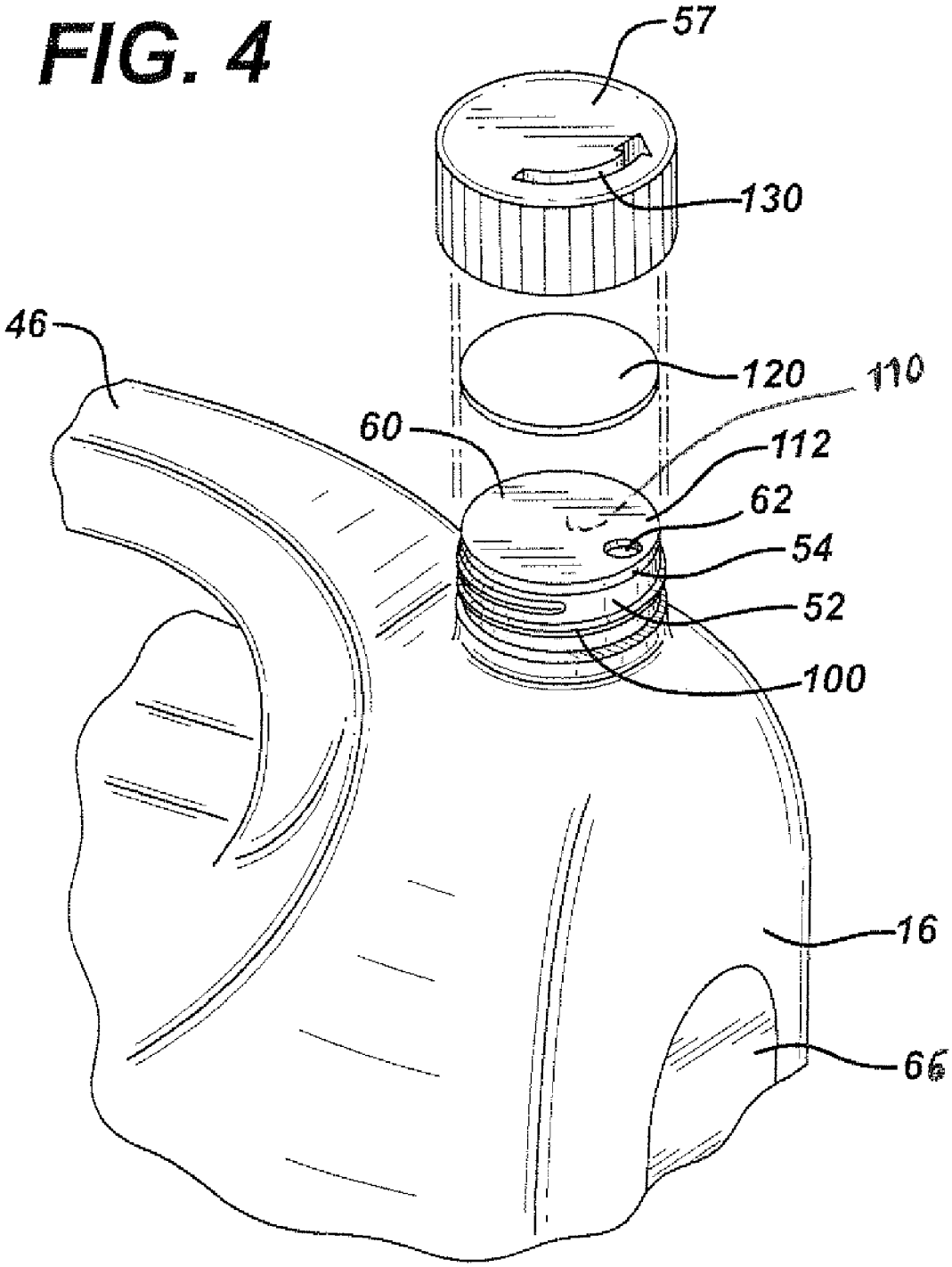
FIG. 4 is an exploded perspective view of the portion of a container with a venting closure according to the invention.

The vent closure of the invention enables the amount of product that may be held in a container which has a vent opening to be increased without spilling during use. As previously stated, in the type of container shown in the figures herein, the container is rested on its front surface 14 during use. The contents of the container will naturally flow towards the front surface during use leaving any headspace in the container towards the back surface 16 (which is the upward most surface when the container is placed in position for use). Obviously, the container can only hold product such that the product level during use of the container remains below the lowest point of the vent opening. The patch of the vent closure of the invention in essence moves the lowest point of the vent opening upward. Accordingly, the vent closure of the invention, by raising the lowest point of the vent opening, enables more of the container to be used for holding product and thus increasing the effective size of the container. For example, referring to FIG. 3, in a conventional container with a conventional vent closure, the lowest point of the vent opening is at 70. In such a container, the container can only hold the amount of product up to a level at or below 70 without it leaking out the vent opening. In a container having the vent closure of the invention, the bottom most level of the vent opening (i.e. the lowest point of aperture 62 in the patch 60) is at 72. Thus, in a container in accordance with the invention, the amount of product held in the container can go up to level at or below 72. As a result, a container having a vent closure in accordance with the invention can hold more product without having to actually increase the size of the container.

To activate the vent the vent cap 57 is loosened. Once the vent cap 57 is loosened, air is free to flow inwardly through aperture 62 thereby replacing the volume of product lost when product is dispensed through spigot 42 with air. This helps the product flow more freely upon being dispensed.

The patch 60 is Liquid impermeable so that if the level of product in the container during use is higher than the lower-most edge 64 of the vent opening, but lower than the aperture 62 in the patch, the product will not spill through the vent. The patch may be made from a single layer of material or may be made of multiple layers of the same or various different materials. The patch has an inner surface 110 and an outer surface 112. The inner surface 110 is the patch surface that directly faces the container opening and is exposed to the product within the container. The outer surface is the patch surface that is opposite the inner surface and faces the vent cap 57 of the venting closure. Preferably the inner surface is a foil layer such as aluminium foil with a heat seal layer such that the patch may be adhered to a portion of the upper edge 54 of the cylindrical neck 52 by induction sealing or other means known in the art. The heat seal layer may be any polymeric film and/or coating that is known for use with induction/heat sealing operations including, without limitation, polyethylene. Other sealing materials and sealing means may be used within the spirit of the invention as long as the patch is sealed to at least a portion of cylindrical neck 52. It is also preferable that the outer surface of the patch has a backing layer 120 that is releasably adhered to the outer surface of the patch such that the backing layer separates from the patch when the vent cap is loosened. The backing layer can be a separate layer that is attached to the outer surface of the patch or can be a part of the patch itself, in which case the surface of the backing layer opposite the patch inner surface will be the patch's outer surface.

The patch may take any form as long as it is impermeable to liquid. Also, it preferably has an inner surface that will adhere to the portion of the upper edge 54 of the cylindrical neck 52. Preferably sealing the patch to a portion of the upper edge 54 of the cylindrical neck 52 is by induction heating. As previously stated, the patch typically and preferably has an inner surface which is a foil and which has on it a heat seal layer. The heat seal layer is actually the layer that is the inner surface, however, it is typically used solely to seal the foil layer to a surface such as a portion of the upper edge 54 of the cylindrical neck 52 and thus the foil may be considered to be the inner surface of the patch. However, the heat seal layer may be a dual role material and thus may be both a material that seals the inner layer to a surface and acts as a barrier of some sort (e.g. fragrance barrier, liquid barrier, etc.). In any case, the patch may have numerous layers.

An example of a patch having numerous layers is one having a heat seal layer, foil, paper, wax, facing, and backing in the order from inner surface to outer surface. In this example, the facing and backing may separate from the rest of the patch and be retained on the inner face of a cap such as the vent cap upon loosening of the cap. The heat seal layer is typically comprised of polymeric films and/or coatings and may be used for barrier, chemical resistance and heat sealing purposes. It can include polyethylene, polypropylene or PET. The foil layer may provide oxygen and moisture barriers. The wax layer temporarily bonds the backing to the foil. The facing layer may include coated paper, paper laminations, coated foil, film and foil combinations, and a wide range of plastic coatings and films. It may provide chemical resistance and be a barrier to oxygen and moisture. The backing may be made of pulp of varying grades and thicknesses or solid foamed polymeric materials. It may provide the compressibility necessary to attain a seal and rigidity required to retain the patch in the vent cap. The above examples of the various layers and materials they can be made of are only examples and are not intended to limit the scope of the claims. The patch may be made of any combination of layers as mentioned above or other types of layers that are known in the art and made be made of any materials that in combination are impermeable to liquid. Sealing patches as described above are available from many suppliers including Self Sealing Products Inc.

Patch 60 may be adhered to an inner surface of vent cap 57. The patch is preferably adhered by an adhesive material as known in the art. Alternatively, patch 60 can be friction fit within the confines of the walls of vent cap 57.

In the illustrated preferred embodiment, the cylindrical neck finish is externally threaded and its external threads 100 mate with internal threads on the walls of the vent cap 57. Alternatively, the vent cap 57 may be a push/pull closure, disc-top or snap-top closure.

During manufacture of the vent closure and containers containing the vent closure, the outer surface 112 of patch 60 is adhered to the inner surface of vent cap 57. The vent cap is then secured to the cylindrical neck 52 of vent 50. The vent, with vent cap on, is then place through an induction heater, which causes the inner surface 110 (preferably a foil layer) of the patch 60 to be sealed to at least a portion of the upper edge 54 of the cylindrical neck 52. The effective usable portion of the container now becomes any portion of the container that is below the portion of the patch that is sealed to the upper edge of the cylindrical neck as well as below the level of the aperture 62 in the patch 60 when the container 10 is placed on its front surface 14 during use. This is a preferred method manufacture, however, other methods that are known in the art or are within the spirit of the invention may also be used.

It is preferred that the patch is attached to whole upper edge of the cylindrical neck so that the level of product is only limited by the location of the aperture in the patch. Likewise, it is preferred that the aperture in the patch is located at an uppermost portion of the patch when the container is positioned during use. In fact, the aperture may intersect the edge of the patch such that the patch simply has a cut-out from its edge that is the aperture in the patch that acts as a vent. While the aperture may be in any shape, it is preferable that the aperture is circular.

In a preferred embodiment, the vent cap 57 has on its outer surface a raised portion 130 which is useful during assembly to ensure that the cap is positioned in essentially the same position in each venting closure thus aiding to position the aperture 62 in the patch 60 in a predetermined position in the vent closure. As previously indicated, it is preferable that the patch 60 is positioned in the vent cap 58 such that the aperture 62 is positioned as close to the back wall (i.e. uppermost wall during use) as possible. The raised portion 130 aids in positioning the cap (and thus the patch) by being detectable by assembly equipment which ensures that the raised portion is in essentially the same position when each vent cap 57 is attached to the cylindrical neck 52 during production. The phrase aperture being "positioned in a predetermined area" is meant to mean that the assembly is controlled by some means, such as that described previously, to position the aperture in an intended area as opposed to a random area. The aperture does not have to be in the exact same location each and every time, as the position may be offset slightly from one application to the next. During assembly, the patch may be inserted into the vent cap such that the aperture in the patch is at essentially the same position within the cap and then the cap may be aligned by the raised portion 130 such that it is at essentially the same position once it is tightened onto the container. This will enable the aperture in the patch to be positioned in a predetermined area for each product coming off of an assembly line.

It will be appreciated that when the container is in its dispensing position resting on front wall 14, it may be desirable to rest measuring cup 44 momentarily. Since it is envisioned that the container may be made of a material, such as certain thermoplastics, which is relatively smooth, in accordance with the invention, a non uniform section may be provided within one of the walls to assist in maintaining the cup in its position while it is disposed on the container. An example is illustrated in FIG. 1 wherein surface 66 which has a racetrack-like periphery, has been etched into rear wall 16.

The container and vent closure may be mono-layer or multi-layer and may be made of, without limitation, HDPE, PP, PVC, PET, POLYCARBONATE or acrylic or nitrite base resins, and preferably contains a minimum of 25% PCR.

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A venting closure comprising:

(a) a cylindrical neck which extends from a container wall, wherein the cylindrical neck has an upper edge and has a given internal diameter that defines a venting opening having a given cross sectional area;

(b) a liquid impermeable patch adhered to at least a portion of the upper edge of the cylindrical neck, wherein the patch covers the venting opening and has an aperture therein positioned off-center from a central point of the patch and wherein the aperture has a cross sectional area that is smaller than the cross sectional area of the cylindrical neck;

(c) a vent cap fastened to the cylindrical neck; and (d) a backing layer releasably adhered to an outer surface of the patch such that the backing layer separates from the patch when the vent cap is loosened.

2. A venting closure according to claim 1, wherein the aperture is positioned in a predetermined area of the venting opening.

3. A venting closure according to claim 1, wherein the patch is comprised of multiple layers including a foil layer and a heat seal layer.

4. A venting closure according to claim 1, wherein the vent cap has an outer surface that has a raised portion which is used to align the cap in position during assembly.

5. A venting closure according to claim 1, wherein the aperture is circular.

6. A container comprising a dispensing opening, a top wall, a side wall, a bottom wall, a front wall, a back wall, a venting opening in at least one of the top, back and side walls, and a venting closure, the venting closure comprising a cylindrical neck which extends from a container wall, wherein the cylindrical neck has an upper edge and has a given internal diameter that defines a venting opening having a given cross sectional area, and a liquid impermeable patch adhered to at least a portion of the upper edge of the cylindrical neck, wherein the patch covers the venting opening and has an aperture therein positioned off-center from a central point of the patch and wherein the aperture has a cross sectional area that is smaller than the cross sectional area of the cylindrical neck, a vent cap fastened to the cylindrical neck, and a backing layer releasably adhered to an outer surface of the patch such that the backing layer separates from the patch when the vent cap is loosened.

7. A container according to claim 6, wherein the aperture is positioned in a predetermined area of the venting opening.

8. A container according to claim 6, wherein the container has a spigot for dispensing product from the dispensing opening and a handle.

9. A container according to claim 6, wherein the top wall of the container includes the venting closure, the vent cap for the venting closure, a handle, a dispensing opening and a dispensing closure covering the dispensing opening.

10. A container according to claim 9, wherein the closure for the dispensing opening includes a measuring cup.

11. A container according to claim 6, wherein the vent cap has an outer surface that has a raised portion which is used to align the cap in position during assembly.

* * * * *